US011844422B2

(12) United States Patent
Lelieveld

(10) Patent No.: US 11,844,422 B2
(45) Date of Patent: Dec. 19, 2023

(54) CONTROLLABLE BRUSH

(71) Applicant: KONINKLIJKE PHILIPS N.V., Eindhoven (NL)

(72) Inventor: Mark Johannes Lelieveld, Shatin (HK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 413 days.

(21) Appl. No.: 17/250,169

(22) PCT Filed: Jun. 25, 2019

(86) PCT No.: PCT/EP2019/066757
§ 371 (c)(1),
(2) Date: Dec. 8, 2020

(87) PCT Pub. No.: WO2020/002289
PCT Pub. Date: Jan. 2, 2020

(65) Prior Publication Data

US 2021/0244172 A1 Aug. 12, 2021

(30) Foreign Application Priority Data

Jun. 28, 2018 (EP) ..... 18180353

(51) Int. Cl.
*A46B 15/00* (2006.01)
*A46B 7/02* (2006.01)
(Continued)

(52) U.S. Cl.
CPC ..... *A46B 15/0006* (2013.01); *A46B 7/023* (2013.01); *A46B 7/06* (2013.01);
(Continued)

(58) Field of Classification Search
CPC ..... A46B 7/023; A46B 7/044; A46B 7/06; A46B 9/023; A46B 9/02
See application file for complete search history.

(56) References Cited

U.S. PATENT DOCUMENTS 1,280,180 A 10/1918 Deason
2,660,183 A 11/1953 Gruring
(Continued)

FOREIGN PATENT DOCUMENTS

CN 106037227 A 10/2016
CN 106333456 A 1/2017
(Continued)

OTHER PUBLICATIONS

International Search Report and Written Opinion dated Sep. 4, 2019 for International Application No. PCT/EP2019/066757 Filed Jun. 25, 2019.

*Primary Examiner* — Shay Karls

(57) ABSTRACT

Controllable brush, comprising a bristle carrier (BC) having a plurality of bristles (B), and a supplementary carrier (SC) having a plurality of protrusions (P), a distance (d) between the supplementary carrier (SC) and the bristle carrier (BC) being modifiable, whereby decreasing the distance (d) results in the protrusions (P) being inserted through the bristle carrier (BC). Decreasing the distance (d) results in the protrusions (P) being inserted inside the bristles (B). Alternatively, decreasing the distance (d) results in the protrusions (P) being inserted between the bristles (B). The controllable brush may further comprise an actuator for modifying the distance (d), and a control unit for controlling the actuator in response to a sensor output. The sensor may be arranged for measuring a force experienced by the brush. Alternatively, the sensor may be a camera of a smartphone.

5 Claims, 1 Drawing Sheet

(51) Int. Cl.
*A46B 7/06* (2006.01)
*A46B 9/02* (2006.01)

(52) U.S. Cl.
CPC ..... *A46B 9/023* (2013.01); *A46B 15/0012* (2013.01); *A46B 2200/104* (2013.01)

(56) References Cited

U.S. PATENT DOCUMENTS

| | | | | |
|---|---|---|---|---|
| 3,668,850 | A * | 6/1972 | Horkey | A01D 7/04 15/105 |
| 3,886,619 | A | 6/1975 | Natman | |
| 5,881,426 | A | 3/1999 | Tong | |
| 6,161,245 | A | 12/2000 | Weihrauch | |
| 6,213,660 | B1 * | 4/2001 | Waller | A46B 11/0006 401/24 |
| 6,308,717 | B1 | 10/2001 | Vrtaric | |
| 6,612,770 | B2 | 9/2003 | Aoyama | |
| 7,814,602 | B2 | 10/2010 | Stydahar | |
| 8,151,397 | B2 | 4/2012 | Moskovich | |
| D668,055 | S | 10/2012 | Khubani | |
| 9,504,311 | B2 | 11/2016 | Putzer | |
| 2008/0115304 | A1 | 5/2008 | Phipps | |
| 2017/0290733 | A1 | 10/2017 | Lin | |

FOREIGN PATENT DOCUMENTS

| | | | | |
|---|---|---|---|---|
| DE | 611649 | C1 | 4/1935 | |
| DE | 951231 | C1 | 10/1956 | |
| JP | 48054256 | A | 7/1973 | |
| WO | 2014/111646 | | 7/2014 | |
| WO | WO-2014111646 | A1 * | 7/2014 | A46B 15/0006 |

* cited by examiner

CONTROLLABLE BRUSH

CROSS REFERENCE TO RELATED APPLICATIONS

This application is the U.S. National Phase application under 35 U.S.C. § 371 of International Application No. PCT/EP2019/066757 filed Jun. 25, 2019, which claims the benefit of European Patent Application Number 18180353.7 filed Jun. 28, 2018. These applications are hereby incorporated by reference herein.

FIELD OF THE INVENTION

The invention relates to a controllable brush, like a hair brush, a tooth brush, or a massage brush.

BACKGROUND OF THE INVENTION

U.S. Pat. No. 6,161,245A discloses a brush with adjustable bristle hardness. The bristles are elastically mounted on a bristle carrier and deflectable at least transversely to their axis and that the deflection angle of the bristles is adjustable. To that end, the brush comprises elastic bearings movably mounting fastening side ends of the bristles on the bristle carrier to permit deflection of the ends of the bristles at least transversely with respect to a longitudinal axis of the bristles, and a control device for adjusting the permissible amount of said transverse deflection of the ends of the bristles. The control device has at least one rigid bearing associated with the elastic bearings and which is spaced from the elastic bearings and can be fed up to the latter by means of the control device. The bristles with their elastic bearings are fixed in holes of a rigid perforated plate, whose front forms a use-side surface of the bristle carrier and wherein said fastening side ends of the bristles project over the perforated plate on the back thereof and wherein the control device with the at least one rigid bearing engages on the areas of the elastic bearings projecting over the perforated plate. The control device has a control plate located in the bristle carrier substantially parallel to the perforated plate and which on its side facing the perforated plate has the at least one rigid bearing associated with the elastic bearings. The control plate is guided in the bristle carrier and from a position in which the distance between said at least one rigid bearing and the elastic bearings is at a maximum can be fed up to the perforated plate, while reducing the distance.

U.S. Pat. No. 2,660,183 A discloses a combination retractable brush and comb construction comprising, a handle body having a top portion, a base portion, and an internal recess extending inwardly from said base portion, a cover plate having therein a plurality of spaced apart openings and being mounted on said handle base portion so as to cover said handle internal recess, a pair of supporting plates mounted within said handle recess in juxtaposed relationship, for sliding movement relative thereto, a plurality of groups of bristles mounted in spaced apart relationship on one of said supporting plates so as to extend outwardly therefrom with the outer ends of each of said groups of bristles slidably engaged in one of said cover plate openings, a plurality of elongated teeth mounted in spaced apart relationship on the other of said supporting plates so as to extend outwardly therefrom with the outer end of each of said teeth slidably engaged in one of said cover plate openings, a pair of control screw members rotatably mounted in spaced apart relationship in said handle body top portion, each of said control members including a threaded portion extending within said handle recess and threadably engaged with one of said supporting plates, whereby independent rotation of either of said control members is adapted to act on the respective supporting plate connected thereto and extend said bristles and/or comb teeth through said cover plate beyond said handle base portion and counter rotation of said control member is adapted to retract said bristles and/or comb teeth within said handle recess.

WO 2014/111646 A1 discloses a comb or hairbrush hair-styling appliance, comprising a handle and a body, an electric battery, a motion sensor or accelerometer, a force sensor, an electronic unit configured to acquire and format signals supplied by the sensors, a wireless communication means for transmitting data to a remote entity, whereby information about the movements imparted to the appliance and the forces exerted can be transmitted to the remote entity, and the remote entity can provide a user of the appliance with feedback containing indications concerning the hair that is being styled.

SUMMARY OF THE INVENTION

It is, inter alia, an object of the invention to provide alternative controllable brushes. The invention is defined by the independent claims. Advantageous embodiments are defined in the dependent claims.

One aspect of the invention provides a controllable brush, comprising a bristle carrier having a plurality of bristles, and a supplementary carrier having a plurality of protrusions, a distance between the supplementary carrier and the bristle carrier being modifiable, whereby decreasing the distance results in the protrusions being inserted through the bristle carrier. Decreasing the distance results in the protrusions being inserted inside the bristles. Alternatively, decreasing the distance results in the protrusions being inserted between the bristles. The controllable brush may further comprise an actuator for modifying the distance, and a control unit for controlling the actuator in response to a sensor output. The sensor may be arranged for measuring a force experienced by the brush. Alternatively, the sensor may be a camera of a smartphone.

These and other aspects of the invention will be apparent from and elucidated with reference to the embodiments described hereinafter.

DESCRIPTION OF EMBODIMENTS

Hair brushes can pull hair. While there exist hair brushes that prevent pulling, e.g. a flexible bristle to let go of the hairs when a knot is identified, a drawback is that these brushes cannot exert high forces on hair as they prevent it, and sometimes do not give the right brushing effect and experience.

Embodiments of the invention provide a controllable flexing of the bristles. One example uses a flexible brush carrier in which bristles have a hollow cavity which can be filled up with a stiffer material to reduce flexing. The stiffer material can be pushed into the flexible bristles manually, or using an actuator. The actuator may be controlled using a sensor input. The sensor may be part of the brush or external to the brush. The sensor may sense a force needed to pull the brush through the hair. The sensor may sense sound resulting when the brush is pulled through the hair, as different hair conditions will result in different sounds when the hair is brushed. An external sensor may be formed by the camera of a smartphone that is connected to the brush e.g. by means of Bluetooth.

Figure 1:
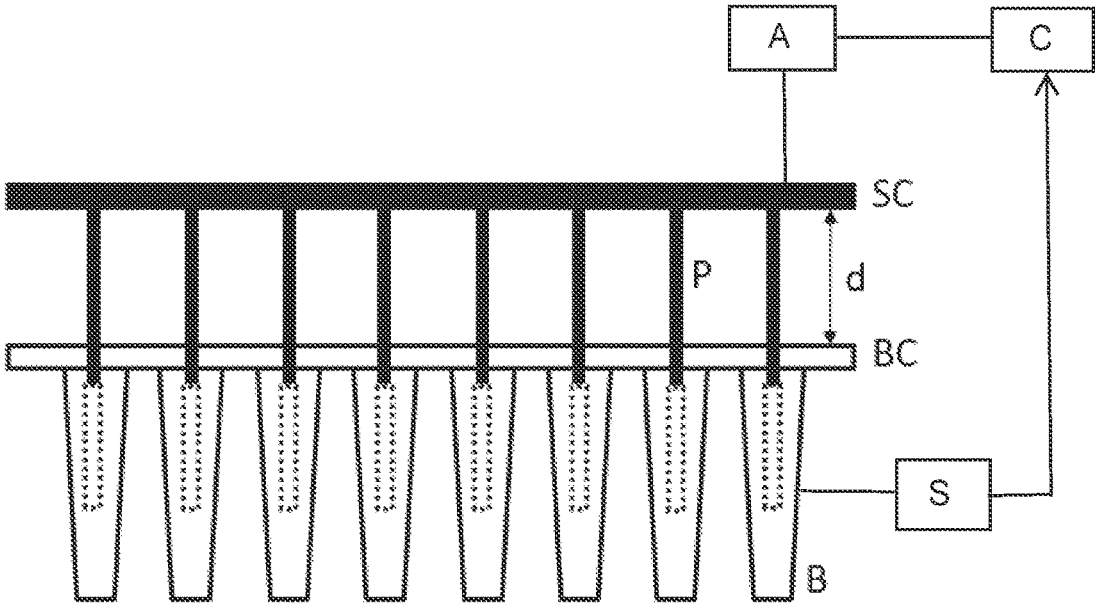
FIGS. 1 and 2 illustrate embodiments of the invention.

FIG. 1 illustrates a first embodiment of the invention. The brush has a bristle carrier BC having a plurality of bristles B which may be made of a (plastic) material normally used for bristles. The brush also has a supplementary carrier SC having a plurality of protrusions P. If a distance d between the bristle carrier BC and the supplementary carrier SC is made smaller, the protrusions P will be inserted through the bristle carrier BC. In particular, in the embodiment of FIG. 1, each protrusion P is inserted into a bristle B, as a result of which the bristle B will become stiffer. This will already happen if the protrusions P are made of the same material as the bristles B. In one example, the protrusions P are made of a material that is stiffer than the material used for the bristles B, thereby increasing the stiffening effect of inserting the protrusions P into the bristles B. In one example, metal is used for the protrusions P and the supplementary carrier SC. Preferably, the materials are chosen such that the protrusions P can easily be inserted into and pulled from the bristles B.

In one example, the protrusions P are inserted into the bristles B only for part of the height of the bristles B, thereby making the bristles B stiffer for only a part of their height. In another example, the protrusions P are inserted through the entire height of the bristles B.

Figure 2:
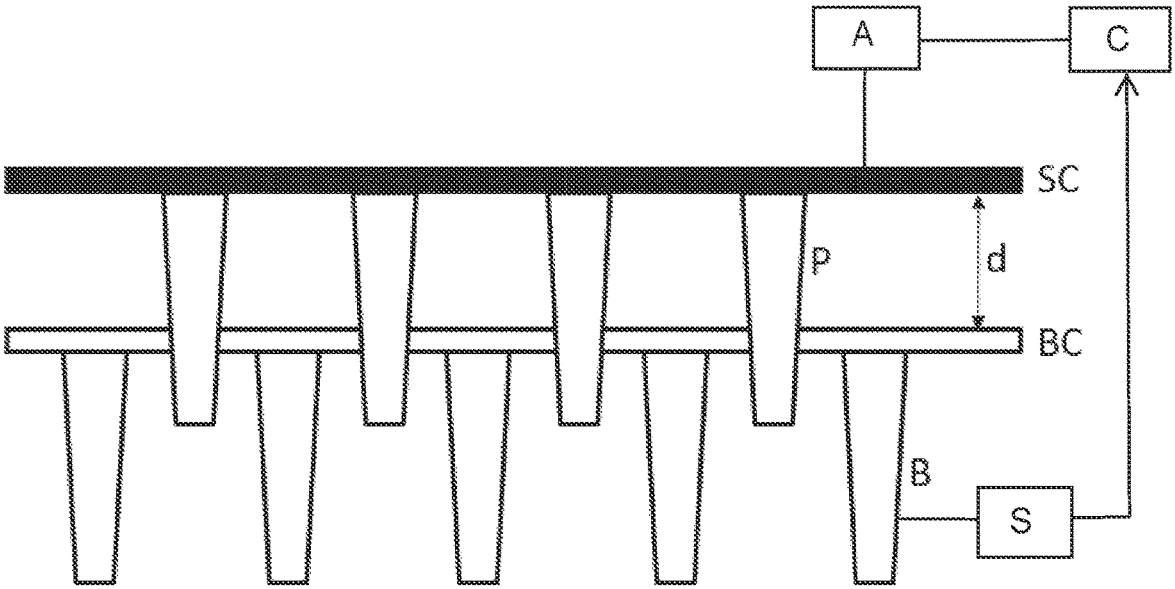

FIG. 2 illustrates a second embodiment of the invention. The embodiment of FIG. 2 differs from the embodiment of FIG. 1 in that if the distance d is made smaller, the protrusions P will be inserted between the bristles B so as to effectively increase the number of bristles, whereby the brush as a whole becomes stiffer. Also, the protrusions P may be stiffer than the bristles B, thereby increasing the overall stiffness of the brush.

In the embodiments of FIGS. 1 and 2, the distance d may be modified manually, or by means of an actuator A. The actuator may be controlled by a control circuit C, which may respond to an output from a sensor S. The control circuit C may be a known control circuit. The sensor may be a force sensor, for example a sensor that measures the presence of tangles, e.g. by measuring a force experienced by the brush while brushing. Alternatively, the sensor may be the camera of a smartphone that "sees" whether the hair is tangled.

It should be noted that the above-mentioned embodiments illustrate rather than limit the invention, and that those skilled in the art will be able to design many alternative embodiments without departing from the scope of the appended claims. The bristles B, and in FIG. 2, the protrusions P, may be shaped differently from the shapes shown in the figures, e.g. more like elongated rectangles and/or with a round tip. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements, and/or by means of a suitably programmed processor. In the device claim enumerating several means, several of these means may be embodied by one and the same item of hardware. Measures recited in mutually different dependent claims may advantageously be used in combination.

The invention claimed is:

1. A controllable brush, comprising:

a bristle carrier having a plurality of bristles;

a supplementary carrier having a plurality of protrusions, wherein a distance between the supplementary carrier and the bristle carrier is modifiable to decrease the distance to insert the protrusions through the bristle carrier;

an actuator adapted to move the supplementary carrier relative to the bristle carrier to modify the distance;

a sensor adapted to measure a force on the brush; and a control circuit adapted to control the actuator in response to and output from the sensor.

2. The controllable brush as claimed in claim 1, wherein decreasing the distance results in the protrusions being inserted inside the bristles.

3. The controllable brush as claimed in claim 1, wherein decreasing the distance results in the protrusions being inserted between the bristles.

4. The controllable brush as claimed in claim 1, wherein the sensor comprises a camera adapted to capture when hair is tangled.

5. The controllable brush as claimed in claim 1, wherein the sensor is a camera of a smartphone.

* * * * *